US009827772B2

(12) United States Patent
Miyazawa

(10) Patent No.: US 9,827,772 B2
(45) Date of Patent: Nov. 28, 2017

(54) INKJET DEVICE AND INKJET METHOD IN WHICH AN INK IS DISCHARGED WHILE BEING CIRCULATED

(71) Applicant: Panasonic Intellectual Property Management Co., Ltd., Osaka (JP)

(72) Inventor: Kazutoshi Miyazawa, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/227,629

(22) Filed: Aug. 3, 2016

(65) Prior Publication Data

US 2017/0066246 A1 Mar. 9, 2017

(30) Foreign Application Priority Data

Sep. 3, 2015 (JP) ..... 2015-173371
May 11, 2016 (JP) ..... 2016-095017

(51) Int. Cl.
*B41J 2/175* (2006.01)
*B41J 2/21* (2006.01)
*B41J 25/304* (2006.01)

(52) U.S. Cl.
CPC ..... *B41J 2/175* (2013.01); *B41J 2/2114* (2013.01); *B41J 25/304* (2013.01)

(58) Field of Classification Search
CPC ..... B41J 2/175; B41J 2/17556; B41J 25/304; B41J 2/2114
See application file for complete search history.

(56) References Cited

U.S. PATENT DOCUMENTS 6,172,688 B1 * 1/2001 Iwasaki ..... B41J 3/4075 347/2
2010/0245494 A1 * 9/2010 Inoue ..... B41J 2/175 347/85

FOREIGN PATENT DOCUMENTS

JP 2008-289983 12/2008
JP 2012-096524 5/2012

* cited by examiner

*Primary Examiner* — Henok Legesse
(74) *Attorney, Agent, or Firm* — Panasonic IP Management; Kerry S. Culpepper

(57) ABSTRACT

An inkjet device includes: multiple coating heads; a supply tank that is connected to the multiple coating heads through a supply pipe;

a first controller that controls the pressure inside the supply tank; and a second controller that causes at least one coating head of the multiple coating heads to come close to an object. An inkjet method includes: (i) selecting at least one coating head from multiple coating heads; (ii) causing the at least one coating head to come close to an object; (iii) increasing a channel resistance of a supply pipe that supplies an ink to the coating head that has been caused to come close to the object; and (iv) coating the ink onto the object from the coating head that has been caused to come close to the object.

14 Claims, 7 Drawing Sheets

INKJET DEVICE AND INKJET METHOD IN WHICH AN INK IS DISCHARGED WHILE BEING CIRCULATED

TECHNICAL FIELD

The technical field relates to an inkjet device and an inkjet method. In particular, the technical field relates to an inkjet device and an inkjet method in which an ink is discharged while being circulated.

BACKGROUND

Inkjet devices discharge an ink from a coating head having multiple nozzles while controlling the amount of the ink. Inkjet devices are widely used for drawing any figures, characters, etc. on surfaces of paper or plastics.

For drawing figures and characters, high-resolution image quality has been required. For production of the devices, it is required to form a highly precise and even functional film. Therefore, with regard to inkjet devices, it is required that even amounts of inks are stably discharged from multiple nozzles in the coating head over time.

Therefore, with regard to the inkjet device disclosed in JP-A-2008-289983, it has been proposed that the pressure inside the coating head is controlled to always be constant, thereby attempting stabilization of ink-discharge. In this inkjet device, a supply tank that supplies an ink to a coating head, and a recovery tank that recovers the ink from the coating head are provided with pressure-control units for controlling the pressure inside the tanks, and the pressures inside the respective tanks are controlled so that the pressure inside the coating head is maintained constant. Thus, by continuously maintaining the pressure inside the coating head constant, the shape of the liquid surface in the discharge port of the nozzle in the coating head can be stabilized, thereby achieving stabilization of ink-discharging.

Furthermore, in the inkjet device disclosed in the JP-A-2012-96524, an ink-supplying pipe and an ink-drawing pipe are connected to a coating head. The ink is drawn into the ink-drawing pipe from the ink-supplying pipe through the coating head. It has been proposed that, according to such a system, discharge of the ink is carried out, while the ink is circulated therein, to thereby achieve stabilization of discharge of the ink.

In the above inkjet device, pressure sensors are installed inside the pipe that supplies the ink to the coating head, and the pipe that draws the ink from the coating head, and the ink is circulated while values indicated by the pressure sensors are adjusted. By circulating the ink therein, air bubbles and extraneous materials inside the coating head are caused to move from the inside of the coating head to the ink-circulating pathway. Thus, when the ink is discharged from the coating head, influences of air bubbles and extraneous materials can be eliminated, thereby realizing stable discharge of the ink.

SUMMARY

The inkjet devices disclosed in JP-A-2008-289983 and JP-A-2012-96524 are premised on formation of predetermined patterns on a work (paper, plastic plates or structures, glass substrates, metal plates or structures, etc.) by discharging the ink thereon. Therefore, the distance between the coating head and the work is constant.

However, when the shape of the work is markedly uneven, it is required that discharge of the ink is carried out while the position of the coating head is adjusted so as to respond to the unevenness in the work. This is because, if the distance between the coating head and the work is not maintained constant, the predetermined patterns would not be appropriately formed on the work.

If, in the inkjet device disclosed in JP-A-2008-289983, the ink is discharged onto a work with a markedly uneven shape while the position of the coating head is changed, rapid changes in the pressure occur inside the head. In this case, based on results obtained by measuring the rapid pressure changes inside the coating head, the pressures inside the supply tank and the recovery tank are adjusted so as to maintain the pressure inside the coating head constant.

However, it is difficult to instantaneously adjust the pressure that rapidly changes, and therefore, the pressure inside the coating head will be high or low. Accordingly, discharge of the ink will be unstable due to leakage of the ink from the respective nozzle holes in the coating head, and incorporation of the air.

Furthermore, when, by use of the inkjet device disclosed in JP-A-2012-96524, the ink is discharged onto a work with a markedly uneven shape while the position of the coating head is changed, rapid changes occur in the pressures inside the coating head and the circulation channels. In this case, adjustment of the amount of the ink supplied to the coating head and the amount of the drawn ink does not catch up with the rapid changes. Therefore, high pressure is rapidly applied to the coating head, and, consequently, large amounts of inks come out of the respective nozzles in the coating head.

Consequently, the discharge of the ink from the coating head will be unstable, and, in some cases, dripping of the ink from the coating head occurs.

In view of the above-described problems in the conventional arts, the present disclosure concerns an inkjet device that achieves stable discharge of inks from the coating head when a predetermined pattern is formed on a work while the position of the coating head is substantially changed with respect to the work.

According to an aspect of the disclosure, an inkjet device includes: multiple coating heads; a supply tank that is connected to the multiple coating heads through a supply pipe; a first controller that controls the pressure inside the supply tank; and a second controller that causes at least one coating head of the multiple coating heads to come close to an object.

Furthermore, according to another aspect of the disclosure, an inkjet method includes: (i) selecting at least one coating head from multiple coating heads; (ii) causing the at least one coating head to come close to an object; (iii) increasing a channel resistance of a supply pipe that supplies an ink to the coating head that has been caused to come close to the object; and (iv) coating the ink onto the object from the coating head that has been caused to come close to the object.

As described above, the inkjet device and the inkjet method according to the disclosure involve a pipe system or valves that make it possible to maintain a constant flow rate of the ink at every position of the coating head. Accordingly, when any coating head(s) of multiple coating heads is located at a lower position, and the ink is discharged from the coating head(s), stable discharge of the ink becomes possible.

DESCRIPTION OF EMBODIMENTS

Hereinafter, one embodiment of the disclosure will be described with reference to drawings.

First Embodiment

Figure 1:
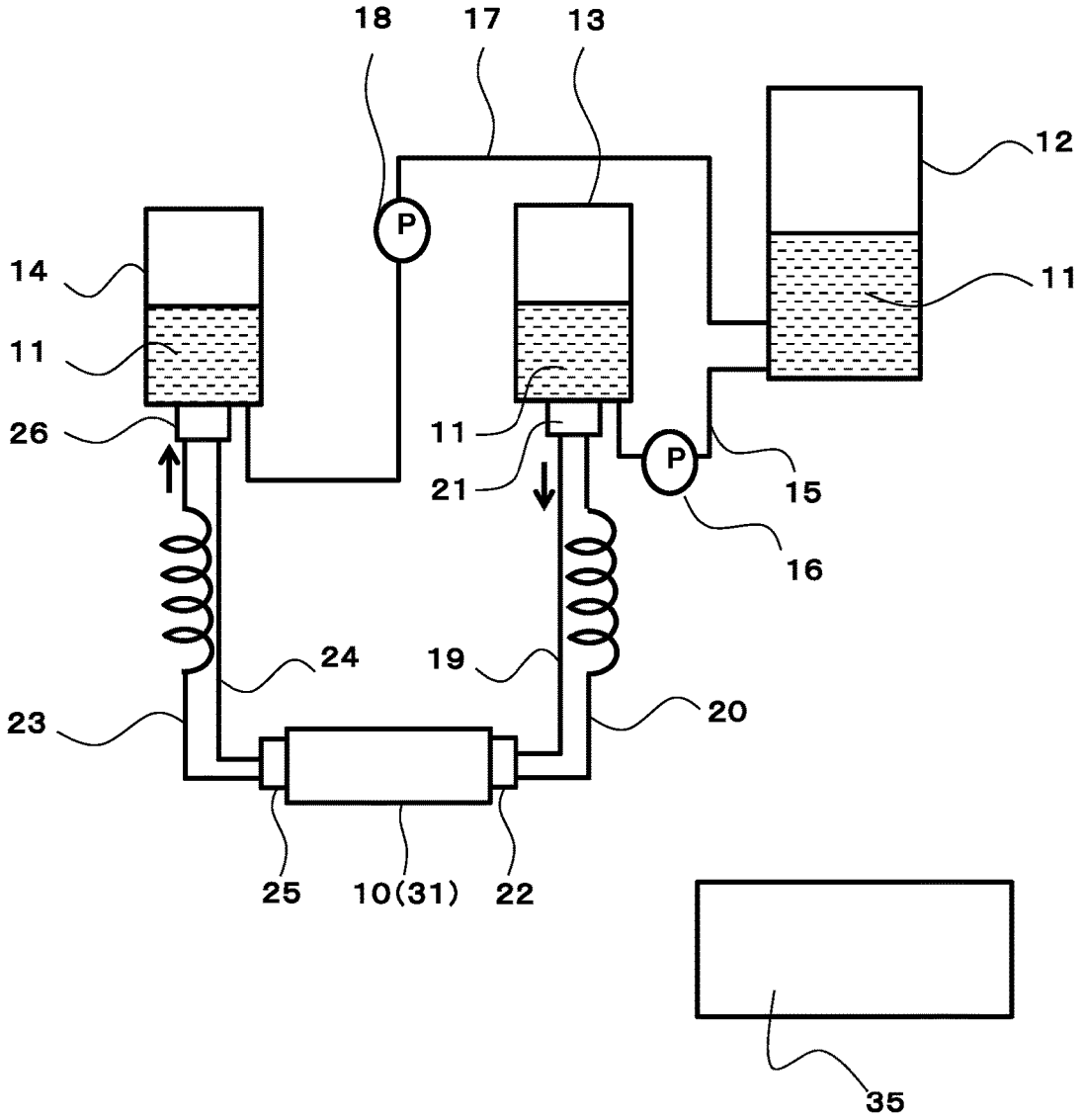
FIG. 1 is a diagram that shows an overall configuration of an inkjet device according to a first embodiment of the disclosure.

FIG. 1 is a schematic view of an inkjet device according to the first embodiment of the disclosure.

The entire body of the inkjet device is covered with a film or metal cover that blocks UV light to prevent inks inside tanks, pipes, and a coating head from deteriorating due to exposure to UV light. This embodiment is compatible with a case where inks for UV light are used. However, in a case where no inks for UV light are used, the above-described measure is not necessarily required.

In the inkjet device, multiple coating heads 10 in which multiple nozzles that discharge predetermined amounts of inks are arrayed, and three tanks, including a storage tank 12 that stores an ink 11, a supply tank 13 that stores an ink 11 that is supplied to the coating heads 10, and a recovery tank 14 that stores an ink 11 that is recovered from the coating head 10, are installed. Furthermore, there is a controller 35 that controls each member. The controller 35 has a processor, etc., and provides control instructions to respective components. Wiring around the controller 35 is omitted in the figure. The controller 35 can also control various components described below.

Hermetic containers are utilized for the respective tanks, and the inks 11 are cut off from the outside air to prevent the inks 11 from deteriorating. In order to conserve the states of inks 11 inside the respective tanks, an inert gas such as nitrogen may be introduced into the tanks.

The storage tank 12 and the supply tank 13 are connected to each other through a pipe 15, and a pump 16 that causes the ink 11 to move between the storage tank 12 and the supply tank 13 is installed in the pipe path. A sensor for detecting the fluid level of the ink 11 is placed inside the supply tank 13, and the pump 16 is controlled based on data from the sensor such that the fluid level of the ink 11 inside the supply tank 13 is continuously maintained constant. The storage tank 12 and the recovery tank 14 are connected to a pipe 17, and a pump 18 that causes the ink 11 to move is placed in the pipe pathway. A sensor for detecting the fluid level of the ink 11 is placed inside the recovery tank 14, and the pump 18 is controlled based on data from the sensor such that the fluid level of the ink 11 is continuously maintained constant.

Two pipes 19 and 20 that have different lengths extend from the supply tank 13, and are connected to the coating head 10. When the ink 11 is supplied from the supply tank 13 to the coating head 10, the ink 11 is supplied by use of either of these two supply pipes 19 and 20. Switching between the supply pipes that supply the ink 11 is carried out by a switching valve 21 that is placed at the side of the supply tank 13, and a switching valve 22 that is placed at the ink-introduced side of the coating head 10. At least two supply pipes may be sufficient.

Two recovery pipes 23 and 24 that have different lengths extend from the coating heads 10, and are connected to the recovery tank 14. At least two recovery pipes may be sufficient. When the ink 11 is collected in the recovery tank 14 from the coating head 10, the ink 11 is supplied by use of either of these two recovery pipes 23 and 24. Switching between the recovery pipes that recover the ink 11 from the coating heads 10 to the recovery tank is carried out by a switching valve 25 that is placed at the ink-recovered side of the coating head 10, and a switching valve 26 that is placed at the side of the recovery tank 14.

In FIG. 1, for simplicity, only one coating head 10, one storage tank 12 for storing the ink 11, one supply tank 13 for supplying the ink 11 to the coating head 10, one recovery tank 14 for recovering the ink 11 from the coating head 10, and one pipe that connects the respective two components are shown. However, in practice, two or more of the respective components may be provided.

The position of any of multiple coating heads 10 can be lowered, and the ink can be discharged from the coating head 10 in a state where the position of the coating head 10 is lowered. Pipes that can decrease or increase the pressure are connected to the supply tank 13 and the recovery tank 14. The pressures inside the supply tank 13 and the recovery tank 14 are controlled to generate a difference in the pressures between the supply tank 13 and the recovery tank 14. By use of the difference in the pressure between the supply tank 13 and the recovery tank 14, the ink 11 is moved from the supply tank 13 to the recovery tank 14 through the coating head 10.

The ink 11 is supplied from or recovered in the storage tank 12 by use of the pumps 16 and 18 such that fluid levels inside the supply tank 13 and the recovery tank 14 are maintained constant.

Thus, a circulation in which the ink 11 moves from the storage tank 12 serving as a cardinal point to the recovery tank 14 by way of the supply tank 13 and the coating head 10, and returns again to the storage tank 12 is formed. In that case, the pressures inside the supply tank 13 and the recovery tank 14 are adjusted so that the amount of the circulating ink is continuously constant. Furthermore, since the discharging state of the ink from the coating head 10 is changed depending on the amount of coated ink 11, and physical properties of materials including the viscosity of the ink, etc., conditions for the pressure difference between the supply tank 13 and the recovery tank 14 are set such that a required amount of the discharged ink 11 can be secured.

A jig for fixing a work (an object) is placed below the coating head 10 of the inkjet device. Hereinafter, "below" means that the coating head 10 comes close to the work. The jig for fixing the work is connected to a robot arm with multiple spindles, and thus, the work can be placed at any position. The position of the coating head 10 is fixed, and the ink is caused to be discharged from the coating head while the work is moved, thereby coating the ink onto the surface of the work. When the work is moved, the distance between the coating head 10 and the work is set so as to be constant.

In advance, a program for movement of the robot arm that is placed on the work is generated based on information of a positional relationship between the shape of the work and the coating head 10. The movement of the robot arm is controlled based on the program for movement of the robot arm, and thus, the robot arm is caused to move in such a manner that the distance between the coating head 30 and the work is maintained constant.

Example 1

Figure 2A:
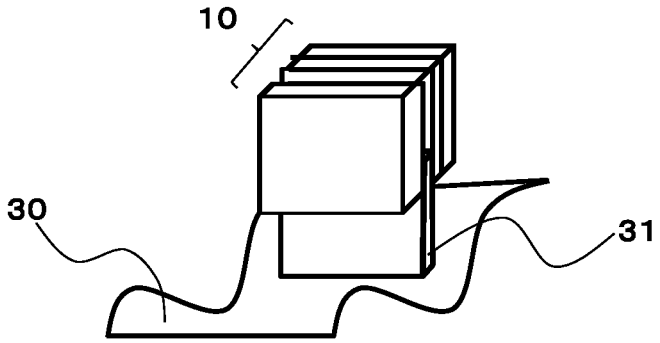
FIG. 2A is a perspective view that shows a positional relationship between a coating head and a planar work in the first embodiment.
Figure 2B:
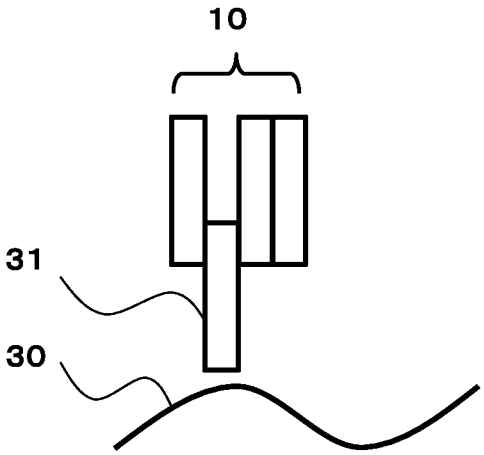
FIG. 2B is a cross-section view of the coating head and the planer work in a coating-initiating position in the first embodiment.
Figure 2C:
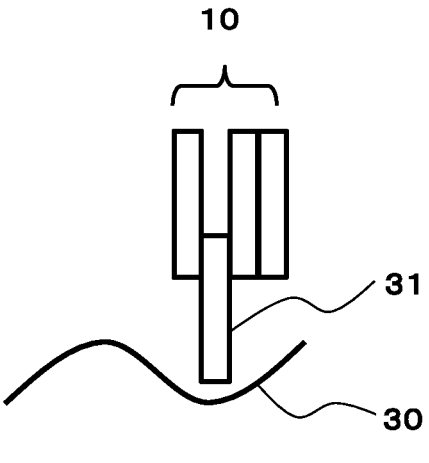
FIG. 2C is a cross-section view of the coating head and the planer work in a coating-end position in the first embodiment.

Example 1 will be described with reference to FIGS. 2A to 2C. FIG. 2A is a perspective view of a coating head. FIGS. 2B and 2C are lateral views of the coating head.

An example in which the ink is discharged from the coating head 10 with respect to a work 30 with large irregularities, thereby forming a predetermined pattern on the work 30, as shown in FIG. 2A, will be shown.

In this case, the coating heads 10 are formed by four coating heads. The coating head 31 that is any one of the four coating heads is set to be located at a position lower than the other coating heads 10.

The ink is caused to be discharged only from the coating head 31 that has been set to be located at the lower position, and the ink is caused not to be discharged from the other coating heads 10. While the work 30 is caused to move from the rear side to the front side of the coating head 31, the ink is caused to be discharged from the coating head 31 with respect to the work, thereby forming a predetermined pattern on the work.

The work 30 is fixed by a robot arm with a multiple-spindle mechanism, and the work is caused to move while the robot arm is controlled such that the distance between the robot arm and the coating head 31 is maintained continuously constant.

FIGS. 2B and 2C show positional relationships between the coating head 10 and the work in a case where the ink is coated onto the work 30 in a state where the coating head 31 is set so as to be located at a position lower than the position of the other coating heads 10.

FIG. 2B shows a cross-section view of the coating heads when the ink from the coating head 31 is started to be coated onto the work 30, and FIG. 2C shows a cross-section view of the coating heads when ink-coating from the coating head 31 onto the work 30 is completed.

As shown in these cross-section views, the shape of the work 30 has large irregularities. Even when the work 30 is moved while the distance between the work 30 and the coating head 31 is maintained constant, any interference between the other coating heads 10 and the work 30 does not occur from the start to the completion of ink-coating. This is because the position of the coating head 31 is lower than the positions of the other coating heads 10.

When it is required that multiple inks are discharged from the coating heads with respect to the work 30, different inks are introduced into the respective coating heads 10, the positions of the coating heads 10 are changed depending on the ink types, and thus, the coating heads 10 each discharge the inks with respect to the work 30.

Comparative Example

Figure 3A:
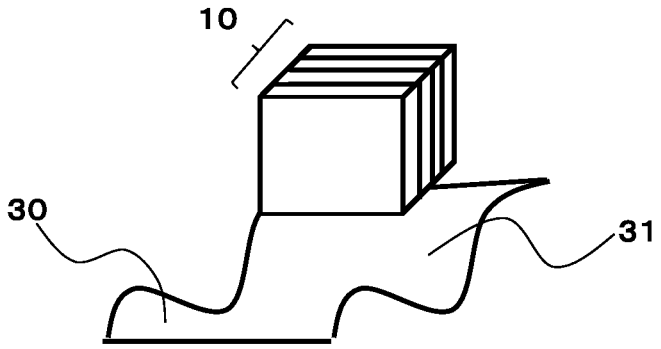
FIG. 3A Prior art
FIG. 3A is a perspective view that shows a positional relationship between a coating head and a planar work in a conventional example.

On the other hand, in a case where, as shown in the perspective view of FIG. 3A, four coating heads 10 are arrayed on the same level with respect to a work 30 with large irregularities, and an ink is discharged from any one coating head 31, to attempt at forming a predetermined pattern, the coating head 10 and the work interfere with each other, and, consequently, the predetermined pattern cannot be formed. While the work 30 is moved from the rear side to the front side of the coating heads 10, and the coating head 31 is controlled such that the distance between the work 30 and the coating head 31 is constant, the ink 11 is discharged from the coating head 31.

Figure 3B:
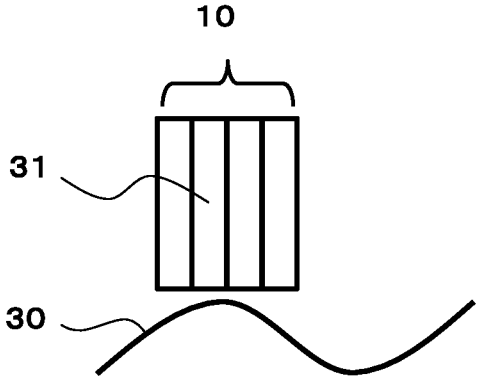
FIG. 3B Prior art
FIG. 3B is a cross-section view of the coating head and the planer work in a coating-initiating position in the conventional example.
Figure 3C:
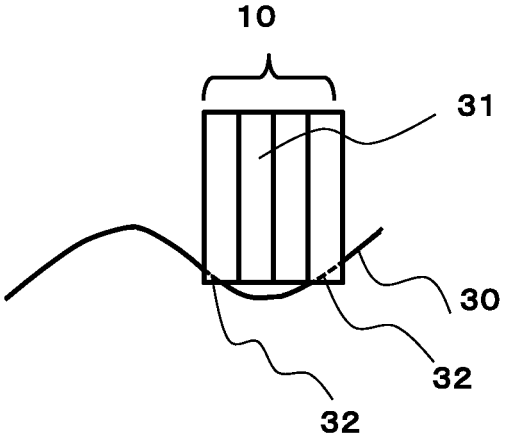
FIG. 3C Prior art
FIG. 3C is a cross-section view of the coating head and the planer work in a coating-end position in the conventional example.

FIG. 3B shows a cross-section view of the coating heads 10 when ink-coating by the coating head 31 is started with respect to the work 30, and FIG. 3C shows a cross-section view of the coating heads when ink-coating by the coating head 10 with respect to the work 30 is completed.

In that case, at completion of coating, as shown in FIG. 3C, if the distance between the coating head 31 and the work 30 is attempted to be maintained constant, interference parts 32 appear between portions of the coating heads 10 other than the coating head 31 and portions of the work 30, and thus, it becomes impossible to coat the ink over the entire surface of the work 30. Therefore, in cases where the ink is discharged from the coating head with respect to the work with large irregularities, thereby forming a predetermined pattern thereon, it is required that the position of the coating head discharging the ink is lowered, as shown in FIGS. 2A to 2C.

<Pressure Adjustment>

As shown in FIGS. 2A to 2C, in a case where one coating head 31 of four coating heads 10 is adjusted to be located at a lower position, and the ink is coated onto the work 30, the above problem in the above comparative example will be solved. However, when the coating head 31 is lowered, the pressure inside the coating head 31 significantly changes.

The pressure inside the coating head 31 will be 10 kPa before the position of the coating head 31 is lowered, and the pressure will be increased to 15 kPa after the position of the coating head is lowered. An example in which, in that case, discharge of the ink from the coating head 31 is stabilized is shown below.

In general, a flow rate of a fluid that flows inside a pipe can be obtained based on Formula 1. ΔP indicates a pressure difference inside the pipe, and C indicates a conductance (proportionality constant).

$$Q=C\cdot\Delta P \qquad \text{(Formula 1)}$$

Since the pressure that is applied to the ink-supplied side of one coating head 31 is increased from 10 KPa to 15 KPa when the position of one coating head 31 is lowered, the flow rate increases 1.5 (15/10) times.

On the other hand, the amount of the ink recovered at the ink-recovered side of the coating head 31 decreases by 1.5 times. Therefore, by lowering the position of the coating head 31, the amount of the ink supplied to the coating head 31 rapidly increases, and, simultaneously, the amount of the ink recovered from the coating head 31 rapidly decreases.

Therefore, a larger amount of the ink flows into the coating head 31, and the ink leaks from respective nozzles of the coating head 31. Due to the leakage of the ink from the respective nozzles of the coating head 31, droplets of the ink adhere to the surface of the coating head, forming cakes thereon. Consequently, unstable discharge of the ink is caused. Also, due to dripping of the ink from the nozzles, the ink clogs the nozzles, resulting in blockage of discharge of the ink from the nozzles.

The conductance shown in Formula 1 is determined by the shape of the pipe. Suppose that the cross-sectional shape of the pipe is circular, the diameter (inner diameter) of the pipe is a, and the length of the pipe is L, it has generally been known that the conductance is expressed by Formula 2.

$$C \propto a^4/L \quad \text{(Formula 2)}$$

When the coating head 31 is caused to locate at the lower position, based on Formula 1, it is required that the value of the conductance C is increased 0.67 (1/1.5) time, in order to maintain the ink flow rate constant at the ink-supplied side.

For this purpose, from Formula 2, it is understood that the length L of the pipe needs to be increased 1.5 times. Furthermore, it is understood that, with the ink-recovering side, the length of the pipe before the coating head 31 is located at the lower position is increased by 1.5 times as large as the length of the pipe after the coating head 31 is located at the lower position.

<Selection of Pipe>

Therefore, before the coating head is located at a lower position, the switching valve for the supply tank, and a switching valve at the ink-supplying side of the coating head are selected so that the ink is caused to flow to the supply pipe that is 0.67 time shorter than the longer pipe, among the two supply pipes that supply the ink from the supply tank to the coating head 31, thereby supplying the ink to the coating head.

Furthermore, the switching valve 25 at the ink-recovering side of the coating head 31, and the switching valve 26 for the recovery tank can be selected so that the ink is caused to flow to the recovery pipe that is 1.5 times longer than the shorter pipe, among the two recovery pipes that recover the ink in the recovery tank 14 from the coating head 31, thereby recovering the ink.

When the coating head is moved to a lower position, the switching valve for the supply tank, and the switching valve at the ink-supplied side of the coating head are selected so that the ink is caused to flow to the supply pipe that is 1.5 times longer than the shorter pipe, among the two supply pipes that supply the ink from the supply tank to the coating head, thereby supplying the ink to the coating head. Additionally, the switching valve at the ink-recovering side of the coating head, and the switching valve at the recovery tank can be selected so that the ink is caused to flow to the recovery pipe that is 0.67 time shorter than the longer pipe, among the two recovery pipes that recover the ink from the coating head to the recovery tank, thereby recovering the ink.

Advantageous Effects

As described above, when the coating head 10 is moved downward, the pipes for circulating the ink are switched, thereby instantaneously controlling the amount of the ink that is caused to flow into the coating head. Accordingly, when the coating head is moved downward, rapid flow of the ink into the coating head can be suppressed, leakage and dripping of the ink from the respective nozzles of the coating head do not occur, and stable discharge of the ink becomes possible.

Thus, in order to coat a predetermined pattern onto a work with large irregularities, it is required that one coating head is located at a lower position, and that the pipe pathways that supply the ink to the coating head, and the pipe pathways for recovering the ink from the coating head are switched. By changing the lengths of the pipe pathways depending on positions of the coating head 31, significant changes in the pressure that is applied to the coating head can be suppressed, and the ink can continuously be circulated at a constant flow rate, thereby realizing stable discharge of the ink.

In addition, multiple pipes with different lengths are switched in the above-described example. However, pipes that have different channel resistances may be switched. When the coating head 10 is moved to a lower position (caused to come close to the work), a pipe with a high channel resistance is used at the ink-supplying side, and a pipe with a low channel resistance is used at the ink-recovering side.

Second Embodiment

Figure 4:
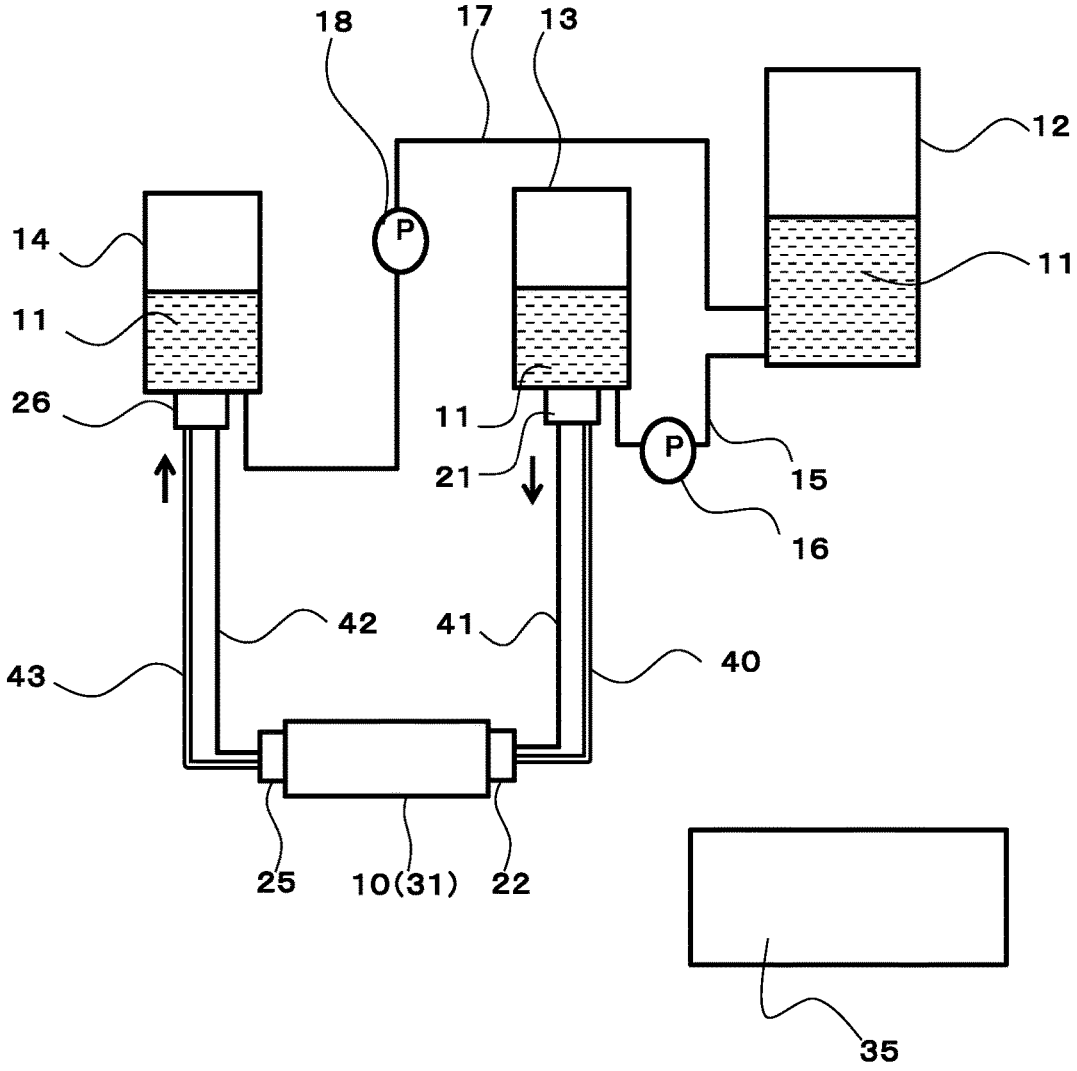
FIG. 4 is a diagram that shows an overall configuration of an inkjet device in a second embodiment.

FIG. 4 shows a schematic view of an inkjet device according to the second embodiment of the disclosure. In FIG. 4, the same reference symbols will be used for the same components as in FIG. 1, and descriptions for the components will be omitted. Matters that are not described below are the same as in the first embodiment.

In the second embodiment, two supply pipes 40 and 41 that extend from the supply tank 13 and that are connected to a coating head 10, and two recovery pipes 42 and 43 for recovering an ink 11 from the coating head 10 are different from the first embodiment.

The supply tank 13 and any coating head 10 are connected through two supply pipes 40 and 41 that have the same length but different diameters (hereinafter, it means that flow passage areas are different). By use of a switch valve 21 that is located at the side of the supply tank 13, and a switch valve 22 that is located at the ink-introducing side of the coating head 10, it switches between these two supply pipes 40 and 41 that are present between the supply tank 13 and the coating head 10, thereby supplying the ink 11 to the coating head 10 at a constant rate.

The coating head 10 and the recovery tank 14 are connected with each other through two recovery pipes 42 and 43 that have the same length but different diameters. By use of a switching valve 25 that is placed at the ink-recovering side of the coating head 10, and a switching valve 26 that is placed at the recovery tank 14, switching between the two recovery pipes 42 and 43 between the coating heads 10 and the recovery tank 14 is carried out so that either of the recovery pipes 42 and 43 recovers ink 11, and thus, adjustment is carried out so that the ink is recovered at a constant flow rate.

Example 2

Example 2 will be described with reference to FIGS. 2A to 2C and FIG. 4. A case in which, as shown in FIG. 2A, an ink is discharged from a coating head 10 with respect to a work 30 having large irregularities, thereby forming a predetermined pattern on the work 30 will be shown.

Four coating heads 10 are arrayed, and any one coating head 31 of the four coating heads is set so as to be located at a position lower than the other coating heads 10. When the coating head 31 is moved to the lower position, the pressure inside the coating head 31 significantly changes.

With regard to a case where the pressure inside the coating head 31 is 10 kPa before the coating head is moved to a lower position, and the pressure is increased to 15 kPa after the coating head 31 is moved to the lower position, discharge of the ink from the coating head is attempted to be stabilized.

When the coating head 31 of the multiple coating heads 10 is moved to a lower position, two supply pipes 40 and 41 that supply the ink 11 from the supply tank 13 to the coating head 10, and two recovery pipes 42 and 43 that recover the ink 11 in the recovery tank 14 from the coating head 10 are switched from each other, thereby attempting at stabilizing the discharge of the ink.

As described in Example 1, in order to maintain a constant amount of the ink that is supplied from the supply tank 13 to the coating head 31 when the coating head 31 is moved to a lower position, it is required that a value of the conductance C in Formula 1 is decreased by 0.67 (1/1.5) time.

For this purpose, based on Formula 2, the diameter of the supply pipe needs to be 0.9 time smaller. Furthermore, in order to maintain a constant amount of the ink that is recovered from the coating head 31 to the recovery tank 14 when the coating head 31 is moved to a lower position, it is understood that the diameter of the recovery pipe before the coating head 31 is moved to a lower position needs to be 0.9 time smaller than the diameter of the pipe after the coating head 31 is moved to the lower position.

Therefore, before the coating head is moved to a lower position, the switching valve 21 for the supply tank 13 is switched so that the ink is caused to flow into the supply pipe 40 that has a diameter 1.1 times larger compared with the supply pipe 41 having a smaller diameter, among the two pipes that supply the ink from the supply tank 13 to the coating head 31, thereby supplying ink 11 to the coating head 31.

Furthermore, when the ink 11 is recovered from the coating head 31 to the recovery tank 14, the switching valve 26 at the recovery side of the coating head can be selected such that the ink 11 is caused to flow into the recovery pipe that has a diameter 0.9 time smaller compared with the recovery pipe having a larger diameter, among the two recovery pipes, thereby recovering the ink 11.

When the coating head 31 is moved to a lower position, the switching valve 21 of the supply tank 13 is switched such that the ink 11 is supplied to the supply pipe 41 that has a diameter 0.9 time smaller compared to the pipe having a larger pipe among the two supply pipes that supply the ink 11 from the supply tank 13 to the coating head 31. Furthermore, the switching valve at the recovery side of the coating head can be switched such that the ink is caused to flow into the recovery pipe that has a diameter 1.1 times larger than the recovery pipe having a smaller diameter, among the two recovery pipes that recover the ink 11 from the coating head 31 to the recovery tank 14, thereby recovering the ink 11.

Thus, in order to coat a predetermined pattern onto a work 30 with large irregularities, diameters of the supply pipes 40 and 41 that supply the ink 11 to the coating head 31, and diameters of the recovery pipes 42 and 43 for recovering the ink from the coating head need to be changed, when the coating head 31 is located at a lower position.

When the position of any one coating head 31 is changed, by changing the diameter of the pipe pathway, significant changes in the pressure applied to the coating head can be suppressed, and the ink 11 can continuously be circulated at a constant flow rate, thereby realizing stable discharge of the ink.

Third Embodiment

Figure 5:
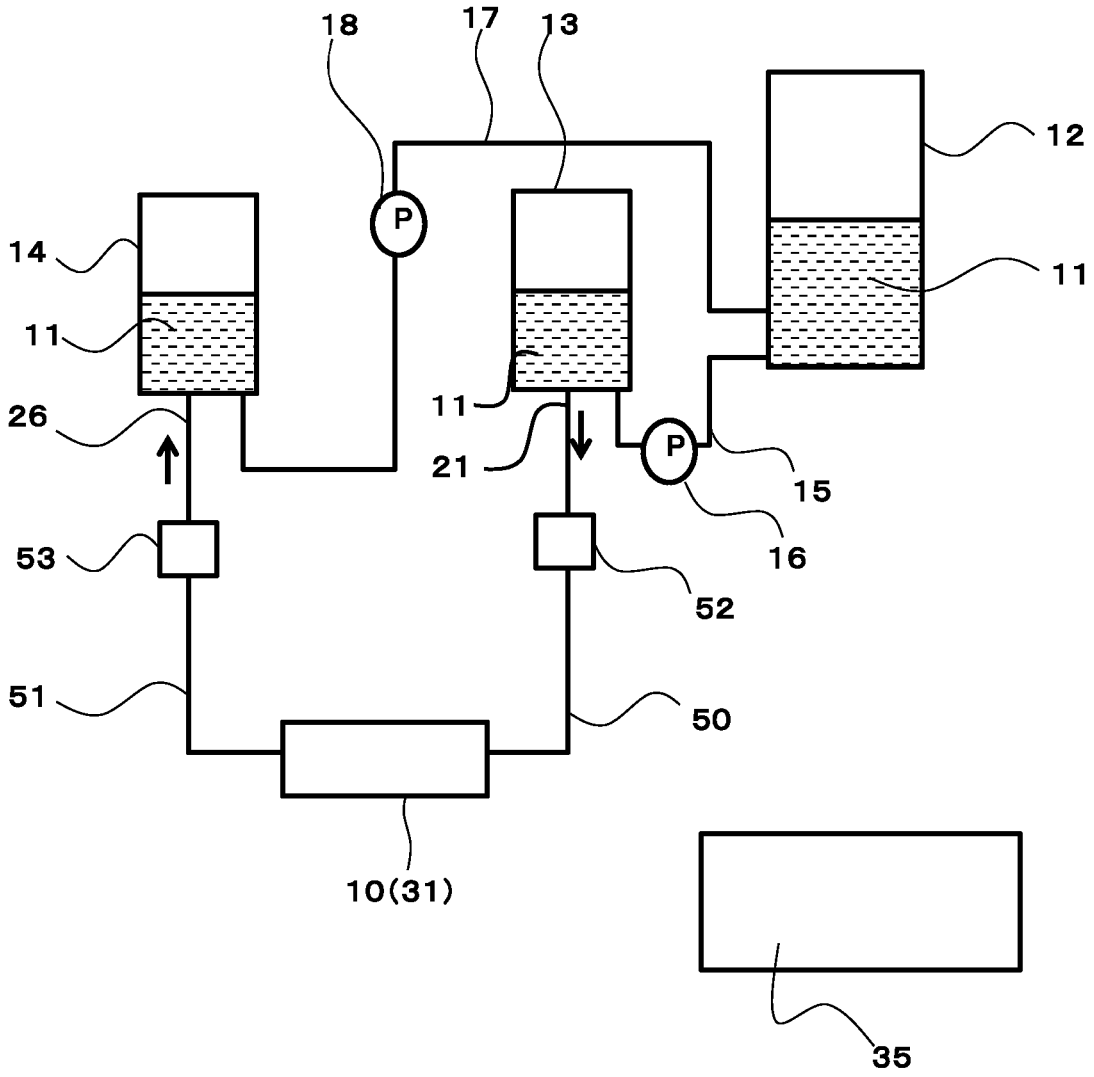
FIG. 5 is a diagram that shows an overall configuration of an inkjet device in a third embodiment.

FIG. 5 shows a schematic view of the inkjet device according to the third embodiment of the disclosure. In FIG. 5, the same reference symbols will be used for the same components as in FIG. 1 described above for the first embodiment, and descriptions for the components will be omitted. Matters that are not described below are the same as in the first embodiment.

In the third embodiment, a supply pipe system that extends from the supply tank 13 and that is connected to the coating head 10, a recovery pipe system for recovering the ink from the coating head are different from the first embodiment.

Supply pipe 50 extends from the supply tank 13 and is connected to the coating head 10. Recovery pipe 51 extends from the coating head 10 and is connected to the recovery tank 14. An adjustment valve 52 for adjusting an amount of the supplied ink (ink flow rate) is placed in the supply pipe 50 that extends from the supply tank 13 and that is connected to the coating head 10, and an adjustment valve 53 for adjusting an amount of the recovered ink is placed in the supply pipe 41 that extends from the coating head 10 and that is connected to the recovery tank 14. By adjusting opening degrees of the adjustment valves 52 and 53 that are attached to the respective pipes, the flow of the ink is controlled such that the ink 11 is caused to flow into the coating head 10 at a constant flow rate.

When the coating head is caused to come close to the work (to move downward), the opening degrees of the adjustment valves 52 and 53 are reduced, thereby making it harder for the ink to flow therethrough.

Example 3

Example 3 will be described with reference to FIGS. 2A to 2C and FIG. 5. An example in which, as shown in FIGS. 2A to 2C, an ink is discharged from coating heads 10 with respect to a work 30 with large irregularities, thereby forming a predetermined pattern on the work 30.

Four coating heads 10 are arrayed, and at least one coating head 31 among the four coating heads is set to locate at a position lower than the other coating heads. When the coating head 31 is caused to move downward, the pressure inside the coating head 31 significantly changes. With regard to a case where the pressure inside the coating head 31 is 10 kPa before the coating head is moved to the lower position and the pressure is increased to 15 kPa after the coating head is moved to the lower position, discharge of the ink from the coating head 31 is attempted to be stabilized.

FIG. 5 shows the entire structure. When the coating head 31 among the multiple heads 10 is moved to a lower position, an opening degree of an adjustment valve 52 that is placed in a supply pipe 50 that supplies the ink 11 from the supply tank 13 to the coating head 31 is adjusted, and an opening degree of an adjustment valve 53 that is placed in a recovery pipe 51 that recovers the ink 11 from the coating head 31 to the recovery tank 14 is adjusted, thereby attempting stabilization of discharge of the ink 11 from the coating head 31.

For that purpose, before the coating head 31 is moved downward, opening degrees of the adjustment valves 52 and 53 have been adjusted to adjust the flow rate of the ink inside the coating head 31, and the opening degrees of the adjustment valves 52 and 53 at that time have been stored.

Then, the coating head 31 is moved downward, the opening degrees of the adjustment valves 52 and 53 are adjusted such that the flow rate of the ink is equal to the flow rate before the coating head 31 is moved downward, and the opening degrees of the respective valves are stored. Opening degrees of the adjustment valves 52 and 53 before and after the coating head 31 is moved downward are set in advance. By setting the opening degrees of the adjustment valves 52 and 53 to those that have been recorded in advance, when the coating head 31 is moved downward, the flow rate of the ink inside the coating head 31 is continuously maintained constant even when the coating head 31 is moved downward.

Thus, in order to coat a predetermined pattern onto a work 30 with large irregularities, it is required that the opening degree of the adjustment valve 52 that is present between the coating head 31 and the supply tank 13, and the opening degree of the adjustment valve 53 that is present between the coating head 31 and the recovery tank 14 are adjusted, when the coating head 31 is moved to a lower position. When the position of the coating head 31 is changed, by adjusting the opening degrees of the adjustment valves 52 and 53 placed in the pipe pathways, significant changes in the pressure that is applied to the coating head 31 are suppressed, and the ink is caused to continuously circulate at a constant flow rate, thereby realizing stable discharge of the ink.

(Additional Features)

In addition, the above-described embodiments can be combined. At least one coating head 31 is moved downward, and multiple coating nozzles may be utilized.

The example in which channel resistances of both of the supply pipes and the recovery pipes are changed is described above. However, only the channel resistance of either of them may be changed.

Furthermore, different methods or mechanism for changing channel resistances may be utilized between the supply pipe(s) and the recovery pipe(s). Multiple methods for changing a channel resistance may be used for one pipe.

Figure 6:
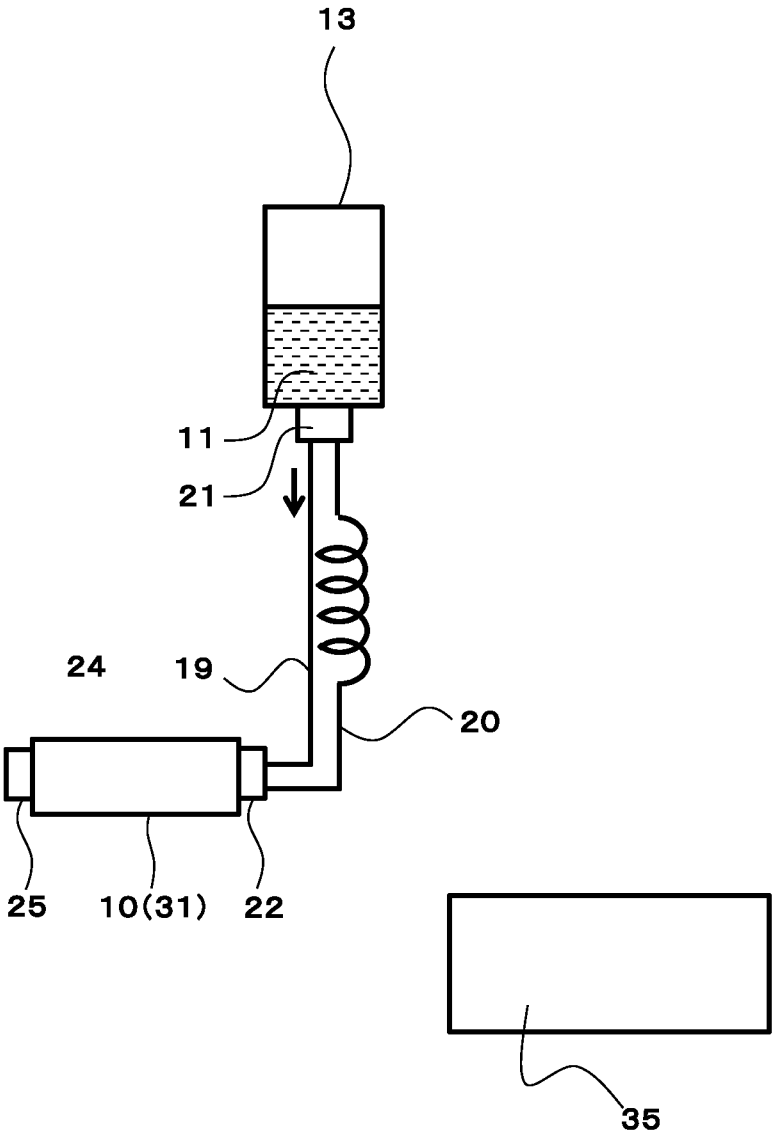
FIG. 6 is a configuration diagram that shows a variation of an inkjet device in an embodiment.

Moreover, the above embodiments utilize circulation systems. However, the disclosure can be applied to a non-circulation system. Such a non-circulation system is illustrated in FIG. 6. FIG. 6 shows a variation of the inkjet device in FIG. 1. That is, according to the disclosure, an inkjet device only including: multiple coating heads 10; a supply tank 13 that is connected to the multiple coating heads 10 through supply pipes 19 and 20; and a controller 35 that controls the pressure inside the supply tank 13 and that controls the multiple coating heads 10 in such a manner that only one or more coating heads 31 among the multiple coating heads 10 come close to an object, and coat the ink 11 onto the object, is also possible.

Figure 7:
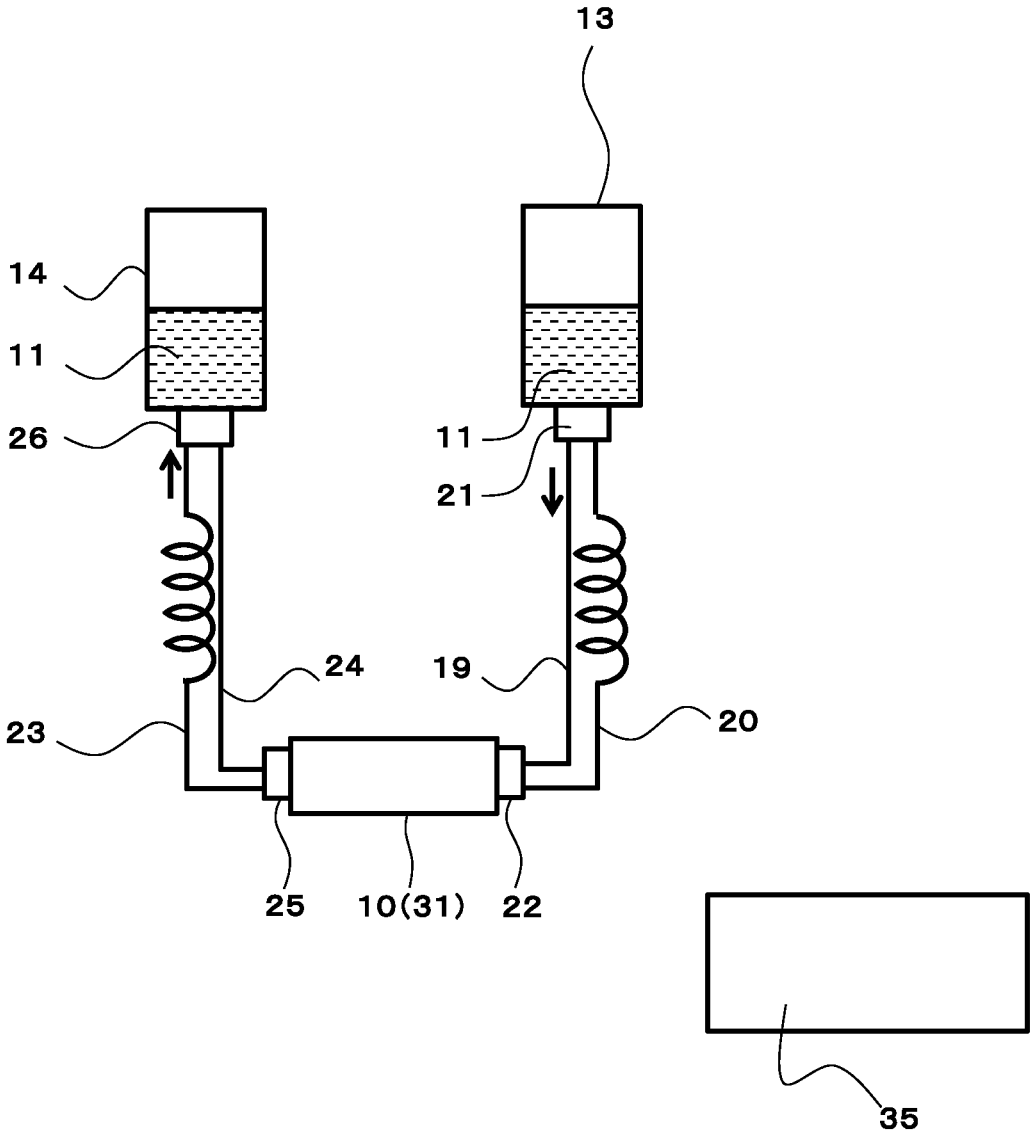
FIG. 7 is a configuration diagram that shows a variation of an inkjet device in an embodiment.

Furthermore, another variation is illustrated in FIG. 7. FIG. 7 shows a variation of FIGS. 1 and 6. That is, according to the disclosure, an inkjet device only including a recovery tank 14 that is connected to the multiple coating heads 10 through recovery pipes 23 and 24, and a controller 35 that controls the pressure inside the recovery tank 14, in the configuration shown in FIG. 6, is also possible.

The above-mentioned switching of the pipes, control of upward and downward movement of coating heads, control of sensors, control of pressures inside the tanks, control of coating of the ink, control of the adjustment valves, control of movement of the work, etc. can be carried out by one or more controllers 35 (a first controller, a second controller, a third controller, etc.). The controller(s) 35 is formed by a computer including a control IC, processor, etc.

The inkjet device according to the disclosure can be used not only for industrial purposes but also for consumer use. For industrial purposes, since an ink can stably be coated onto a work with large irregularities, the inkjet device can be utilized for application of decoration designs to complex shapes, formation of a functional film onto devices with three-dimensional structures, etc. The disclosure can widely be used as an inkjet device for other purposes.

What is claimed is:

1. An inkjet device, comprising:

multiple coating heads;

a supply tank that is connected to the multiple coating heads through a supply pipe;

a first controller that controls the pressure inside the supply tank; and a second controller that causes at least one coating head of the multiple coating heads, not all of coating heads, to come close to an object.

2. The inkjet device according to claim 1, further comprising a third controller that causes the object to move relative to the multiple heads.

3. The inkjet device according to claim 1, further comprising a fourth controller that changes the channel resistance of the supply pipe.

4. The inkjet device according to claim 1, further comprising:

a recovery tank that is connected to the multiple heads through a recovery pipe;

a fifth controller that controls the pressure inside the recovery tank; and a sixth controller that changes the channel resistance of the recovery pipe.

5. The inkjet device according to claim 1, further comprising:

a storage tank that is connected to the supply tank and the recovery tank;

a first pump that is located between the supply tank and the storage tank; and a second pump that is located between the recovery tank and the storage tank.

6. The inkjet device according to claim 1, further comprising a plurality of the supply pipes, wherein the plurality of the supply pipes have the same flow channel cross-sectional areas but different lengths, the plurality of the supply pipes directly connect the multiple coating heads to the supply tank, there is nothing other than the plurality of the supply pipes between the multiple coating heads and the supply tank.

7. The inkjet device according to claim 6, further comprising a switching part that switches between the plurality of the supply pipes by causing the coating head to come close to the object.

8. The inkjet device according to claim 1, further comprising a plurality of the supply pipes, wherein the plurality of the supply pipes have the same length but different flow channel cross-sectional areas.

9. The inkjet device according to claim 1, wherein the supply pipe is provided with an adjustment part that adjusts the flow rate of the ink.

10. The inkjet device according to claim 1, wherein the second controller causes only one coating head of the multiple coating heads to come close to the object.

11. The inkjet device according to claim 1, wherein the second controller coats the ink to the object with the coating head which come close to the object.

12. An inkjet device, comprising:

multiple coating heads;

a supply tank that is connected to the multiple coating heads through a supply pipe;

a first controller that controls the pressure inside the supply tank;

a second controller that causes at least one coating head of the multiple coating heads to come close to an object; and a fourth controller that changes the channel resistance of the supply pipe wherein the channel resistance of the supply pipe in the coating head that has been caused to come close to the object is larger than the channel resistance of the supply pipe in the coating head that has not been caused to come close to the object.

13. An inkjet device, comprising:

multiple coating heads;

a supply tank that is connected to the multiple coating heads through a supply pipe;

a first controller that controls the pressure inside the supply tank;

a second controller that causes at least one coating head of the multiple coating heads to come close to an object, a storage tank that is connected to the supply tank and the recovery tank;

a first pump that is located between the supply tank and the storage tank; and a second pump that is located between the recovery tank and the storage tank wherein the channel resistance of the recovery pipe in the coating head that has been caused to come close to the object is larger than the channel resistance of the recovery pipe in the coating head that has not been caused to come close to the object.

14. An inkjet device, comprising:

multiple coating heads;

a supply tank that is connected to the multiple coating heads through a supply pipe;

a controller configured by instructions to control the pressure inside the supply tank and cause at least one coating head of the multiple coating heads to come close to an object, a storage tank that is connected to the supply tank and the recovery tank;

a first pump that is located between the supply tank and the storage tank; and a second pump that is located between the recovery tank and the storage tank, wherein the channel resistance of the recovery pipe in the coating head that has been caused to come close to the object is larger than the channel resistance of the recovery pipe in the coating head that has not been caused to come close to the object.

* * * * *